US005928394A

United States Patent [19]

Stoetzel

[11] Patent Number: 5,928,394

[45] Date of Patent: Jul. 27, 1999

[54] DURABLE ABRASIVE ARTICLES WITH THICK ABRASIVE COATINGS

[75] Inventor: William L. Stoetzel, St. Paul, Minn.

[73] Assignee: Minnesota Mining and Manufacturing Company, St. Paul, Minn.

[21] Appl. No.: 08/961,285

[22] Filed: Oct. 30, 1997

[51] Int. Cl.[6] ..... B24D 3/00

[52] U.S. Cl. ..... 51/295; 51/297

[58] Field of Search ..... 51/293, 295, 297, 51/298

[56] References Cited

U.S. PATENT DOCUMENTS

| | | |
|---|---|---|
| 1,910,444 | 5/1933 | Nicholson . |
| 3,041,156 | 6/1962 | Rowse . |
| 3,594,865 | 7/1971 | Erb . |
| 3,605,349 | 9/1971 | Anthon . |
| 3,867,795 | 2/1975 | Howard . |
| 4,255,164 | 3/1981 | Butzke et al. . |
| 4,311,489 | 1/1982 | Kressner . |
| 4,314,827 | 2/1982 | Leitheiser et al. . |
| 4,623,364 | 11/1986 | Cottringer et al. . |
| 4,642,126 | 2/1987 | Zador et al. . |
| 4,644,703 | 2/1987 | Kaczmarek et al. . |
| 4,652,274 | 3/1987 | Boettcher et al. . |
| 4,652,275 | 3/1987 | Bloecher et al. . |
| 4,735,632 | 4/1988 | Oxman et al. . |
| 4,744,802 | 5/1988 | Schwabel . |
| 4,751,138 | 6/1988 | Tumey et al. . |
| 4,773,920 | 9/1988 | Chasman et al. . |
| 4,799,939 | 1/1989 | Bloecher et al. . |
| 4,903,440 | 2/1990 | Larson et al. . |
| 4,950,696 | 8/1990 | Palazotto et al. . |
| 4,959,265 | 9/1990 | Wood et al. . |
| 4,985,340 | 1/1991 | Palazotto et al. . |
| 4,997,461 | 3/1991 | Markhoff-Matheny et al. . |
| 5,009,675 | 4/1991 | Kunz et al. . |
| 5,011,508 | 4/1991 | Wald et al. . |
| 5,042,991 | 8/1991 | Kunz et al. . |
| 5,077,870 | 1/1992 | Melbye et al. . |
| 5,085,671 | 2/1992 | Martin et al. . |
| 5,107,626 | 4/1992 | Mucci ..... 51/295 |
| 5,135,546 | 8/1992 | Sato et al. . |
| 5,152,917 | 10/1992 | Pieper et al. . |
| 5,178,646 | 1/1993 | Barber, Jr. et al. . |
| 5,190,568 | 3/1993 | Tselesin . |
| 5,199,227 | 4/1993 | Ohishi . |
| 5,213,951 | 5/1993 | Delfino . |
| 5,236,472 | 8/1993 | Kirk et al. . |
| 5,256,170 | 10/1993 | Harmer et al. . |
| 5,304,223 | 4/1994 | Pieper et al. ..... 51/295 |
| 5,304,224 | 4/1994 | Harmon ..... 51/295 |
| 5,368,619 | 11/1994 | Culler . |
| 5,378,251 | 1/1995 | Culler et al. . |
| 5,378,252 | 1/1995 | Follensbee . |
| 5,417,726 | 5/1995 | Stout et al. . |
| 5,435,816 | 7/1995 | Spurgeon et al. . |
| 5,437,754 | 8/1995 | Calhoun . |
| 5,454,844 | 10/1995 | Hibbard et al. . |
| 5,500,273 | 3/1996 | Holmes et al. . |
| 5,674,122 | 10/1997 | Krech . |

FOREIGN PATENT DOCUMENTS

| | | |
|---|---|---|
| 6-278042 | 10/1994 | Japan . |
| 7-328932 | 12/1995 | Japan . |
| 8-187665 | 7/1996 | Japan . |
| WO 93/12911 | 7/1993 | WIPO . |
| WO 95/07797 | 3/1995 | WIPO . |
| WO 95/22436 | 8/1995 | WIPO . |
| WO 97/06926 | 2/1997 | WIPO . |
| WO 97/11484 | 3/1997 | WIPO . |
| WO 97/12727 | 4/1997 | WIPO . |

*Primary Examiner*—Deborah Jones

*Attorney, Agent, or Firm*—Gregory J. Feulner; Paul W. Busse

[57] ABSTRACT

The present invention relates to an abrasive article containing an abrasive coating having more than one abrasive composite layer, wherein each abrasive composite layer has undergone at least one curing process. The abrasive article of the present invention has enhanced durability as a result of the essentially complete curing of each abrasive composite layer of the abrasive coating. The invention includes the method of making an abrasive article with enhanced durability.

25 Claims, 1 Drawing Sheet

DURABLE ABRASIVE ARTICLES WITH THICK ABRASIVE COATINGS

FIELD OF THE INVENTION

This invention relates to durable abrasive articles having thick abrasive coatings. The thick abrasive coatings have at least two abrasive composite layers with each layer having undergone at least one curing process. In all instances, at least one abrasive composite layer forms an array of shaped abrasive composite structures. This invention also pertains to a method of making abrasive articles having thick abrasive coatings.

BACKGROUND OF THE INVENTION

An abrasive article usually consists of an abrasive coating attached to a backing. During most abrading applications, the exposed surface of an abrasive coating contacts, under pressure, an exposed surface of a workpiece. The abrasive coating becomes altered by the contact and the movement of the abrasive article against the workpiece. Such contact and movement have been known to cause the removal of an abrasive coating from an abrasive article. Forceful surface modification processes in which an abrasive article, contacts a hard workpiece, under high pressure, have been known to quickly erode the abrasive coating from the backing of an abrasive article, rendering the abrasive article ineffective in subsequent abrading applications.

A durable abrasive article is capable of contacting a workpiece under pressure for a long duration, if necessary, or contacting the surface of a large number of individual workpieces, under pressure, for short durations, and yet adequately abrade or polish the surface of the workpiece(s). An abrasive article with a thick abrasive coating theoretically should have a greater durability than an abrasive article with a thin abrasive coating, because it should take longer for the surface modification process to wear away the additional abrasive coating of the thick abrasive article.

Typically, abrasive coatings of lapping coated abrasive articles, or fixed abrasive articles, comprise a single layer of abrasive material. The thickness of these single layer abrasive coatings may vary in size depending upon the components that make up the abrasive coating. For example, the thickness of an abrasive coating of a lapping coated abrasive article maybe 7 $\mu$m, 10 $\mu$m, or 22 $\mu$m. These abrasive coatings are typically formed by applying an abrasive material containing abrasive particles dispersed in a binder to a backing. The binder typically contains either radiation or thermally curable precursor polymer subunits and initially flows when applied to a backing. Then, the precursor polymer subunits of the abrasive coating are cured by the application of heat and/or radiation and the curable abrasive coating is converted into a hard, or cured, abrasive coating.

Sometimes problems develop during the curing of a curable abrasive coating. The physical characteristics of a particular abrasive coating (its components) and/or a particular curing process will affect the outcome of the manufactured abrasive article. One curing process utilizes abrasive coatings containing radiation curable precursor polymer subunits and a radiation energy source. Radiation energy applied to an abrasive coating should be able to initiate polymerization reactions, or crosslinking reactions, so that the precursor polymer subunits become part of a larger polymer chain. In addition, the radiation energy, in part, must also be able to penetrate the abrasive coating so that underlying material becomes essentially cured. Specifically, radiation energy is typically only able to polymerize or crosslink suitable precursor polymer subunits in radiation penetrable regions of the abrasive coating. In regions of the abrasive coating not penetrable by radiation, the precursor polymer subunits do not readily become part of a larger polymer chain through chemical reactions.

Typically, there is a practical limit as to the thickness a specific type of radiation energy is able to penetrate a curable abrasive coating. Factors related to the penetration of radiation through an abrasive coating and the practical thickness limit of an abrasive coating include, but are not limited to, the amount and type of precursor polymer subunits in a curable abrasive coating, the amount and type of abrasive particles in a curable abrasive coating, the length of time the radiation energy is applied to a curable abrasive coating, the type of radiation energy applied to a curable abrasive coating, and the type of photoinitiator present in a curable abrasive coating. If the thickness of the abrasive coating is greater than its practical thickness limit, the region of the abrasive coating beyond this practical thickness limit is not penetrable by the applied radiation. An abrasive coating having undergone a radiation curing process where its thickness of the abrasive coating is greater than its practical thickness limit may only partially cure. A partially cured abrasive article used in a surface modification process will tend to result in the surface modification process quickly wearing the abrasive coating from the backing of the abrasive article. This abrasive article with a partially cured coating may not properly abrade or polish a workpiece if continued to be used in the same surface modification process, or if the abrasive article is used in future modification processes in combination with new workpieces.

Alternatively, an abrasive coating may contain thermally curable precursor polymer subunits, instead of radiation curable precursor polymer subunits. Heat is able to penetrate most abrasive coating compositions, if the abrasive coating is heated long enough. However, as the thickness of an abrasive coating increases, heat tends to crack the abrasive coating during the heat curing step during the manufacture of the abrasive article. There is a practical thickness limit inherent in abrasive coatings that are heat curable that can be defined as the thickness of the abrasive coating at which cracking tends to occur upon heat curing. This practical thickness limit would be dependent on factors such as the components of the abrasive coating, the duration of the heat curing step, and the temperature of the thermal curing process. It is not unusual that heat curing of very thick layers of abrasive coating may result in voids and air bubbles being formed in the coating during thermal curing of the coating. Abrasive articles, containing cracked or bubbled abrasive coatings may result in non-uniform abrading or polishing and are likely to wear quickly when used in surface modification processes.

SUMMARY OF THE INVENTION

One embodiment of this invention is a durable abrasive article that includes a thick abrasive coating provided on a backing. Specifically, the invention embodies an abrasive article having a thick abrasive coating that includes at least two cured abrasive composite layers, wherein at least one of the cured abrasive composite layers comprises an array of shaped abrasive composite structures. The abrasive article of the present invention has a first abrasive composite layer including first precursor polymer subunits. Coextensive with the first abrasive composite layer is a backing. At least a second abrasive composite layer is coextensive with and interposed between the first abrasive composite layer and the backing. The second abrasive composite layer includes second precursor polymer subunits. At least one of the abrasive composite layers includes an array of shaped abrasive composite structures, preferably precisely shaped, and each abrasive composite layer has undergone at least one curing process. The thickness of an abrasive composite layer is less than or equal to its practical thickness limit. An abrasive article of the present invention contains an abrasive coating that may contain a third, fourth or even more abrasive composite layers. The thickness of the abrasive coating of an abrasive article depends on the number of essentially cured abrasive composite layers within a given coating. Typically, each abrasive composite layer of an article of this invention comprises abrasive particles dispersed within precursor polymer subunits.

A second embodiment of the present invention includes a method of making an abrasive article with a thick abrasive coating, wherein at least one cured abrasive composite layer forms an array of shaped abrasive composites structures, preferably precisely shaped abrasive composite structures. A first curable abrasive composite layer that includes first precursor polymer subunits is applied to a backing with a thickness less than or equal to its practical thickness limit. The first curable abrasive composite is essentially cured by radiation or thermal curing to form a first cured abrasive composite layer. At least a second curable abrasive composite layer that includes second precursor polymer subunits is applied to the exposed surface of the first cured abrasive composite layer. The thickness of the second layer of abrasive composite applied to the first abrasive composite layer is less than or equal to its practical thickness limit. The second curable abrasive composite layer is essentially cured while associated with the first cured abrasive composite layer to form a second cured abrasive composite layer. The article manufactured by the above method is described as having a first abrasive composite layer interposed and coextensive with the backing and the second abrasive composite layer. However, an abrasive article of the present invention is described as having at least a second layer coextensive and interposed between a backing and a first abrasive composite layer. The descriptions of the article of the invention and the method should not confuse the reader and are used to fully describe the invention. Typically, each abrasive composite layer of the abrasive article produced by the method comprises a plurality of abrasive particles dispersed within a binder.

The method also includes the steps of contacting at least one of the abrasive composite layers with a production tool comprising a plurality of cavities prior to the curing of the (at least one) abrasive composite layer. Specifically, abrasive composite layers including an array of shaped abrasive composite structures, either precisely shaped or irregularly shaped, are generally formed by applying a layer of curable abrasive composite to a plurality of cavities of a production tool before the curing step. The production tool may be brought into contact with (i.e., pressed against) a layer of curable abrasive composite prior to, or after, the step of applying the curable abrasive composite to a backing. If a curable abrasive composite layer is to be applied to a cured abrasive composite layer, then, a production tool may be brought in contact with the curable abrasive composite prior to, or after, the step of applying the layer of curable abrasive composite to the cured abrasive composite layer. Abrasive composite layers substantially free of an array of shaped abrasive composite structures are typically formed by the above method without the use of a production tool and can be formed, for example, by the methods of making a conventional lapping abrasive article as described in Culler et al., U.S. Pat. No. 5,378,251, incorporated herein by reference.

The following definitions are used throughout this patent application:

"abrasive composite structures" refers to a plurality of shaped bodies which collectively provide a textured, three-dimensional abrasive composite layer.

"precisely shaped" means that the abrasive composite structures have a distinct and discernible shape. This shape may be a geometric shape, random shape or combination thereof. In general, precisely shaped abrasive composite structures are formed by curing a precursor polymer subunits in the cavities of a tooling. Additional information on precisely shaped abrasive composite structures can be found in U.S. Pat. No. 5,152,917 (Pieper et al.) incorporated herein by reference.

"irregularly shaped" means that the abrasive composite structures are not precise in that the precursor polymer subunits has not fully cured in the cavities of a production tool, before the production tool is removed from the abrasive composite layer.

"associated with" refers to attachment to, bonding to, or permeation throughout an element of an abrasive composite layer.

"thickness" refers to the dimension between two surfaces of an object, such as between the two longest surfaces of an abrasive composite layer.

"practical thickness limit" when relating to:

(a) abrasive composite layers containing radiation curable precursor polymer subunits, refers to a thickness measurement of an abrasive composite layer at which a specific type of radiation energy is able to effectively penetrate so as to effect essentially complete cure of the abrasive composite layer. If the abrasive composite layer has a thickness greater than this thickness measurement, when radiation is applied to one surface of the abrasive composite layer it is unable to penetrate all of the abrasive composite material and effect essentially complete cure of abrasive composite material located beyond the above thickness measurement, (b) abrasive composite layers containing thermally curable precursor polymer subunits, refers to a thickness measurement of an abrasive composite layer that results in minimal cracking and bubbling of the abrasive composite layer upon heat curing. If the abrasive composite layer is thicker than this thickness measurement, heat curing of the abrasive composite layer will tend to crack or bubble the abrasive composite layer.

Other features, advantages, and constructs of the invention will be better understood from the following description of figures and the preferred embodiments of the present invention.

DETAILED DESCRIPTION

Most abrasive articles contain a single abrasive coating, with a thickness dependent on the practical thickness limit of the coating. Such single coated abrasive articles typically have restricted durability and surface modification characteristics because of physical limitations associated with the manufacture of the abrasive articles. An abrasive article of the present invention includes a thick abrasive coating having at least two abrasive composite layers coextensive with a backing and each abrasive composite layer having undergone at least one curing process. The thickness of any one abrasive composite layer being less than the practical thickness limit of that particular abrasive composite composition prior to curing. An example of an abrasive article having a thick abrasive coating is illustrated in FIG. 1.

Figure 1:
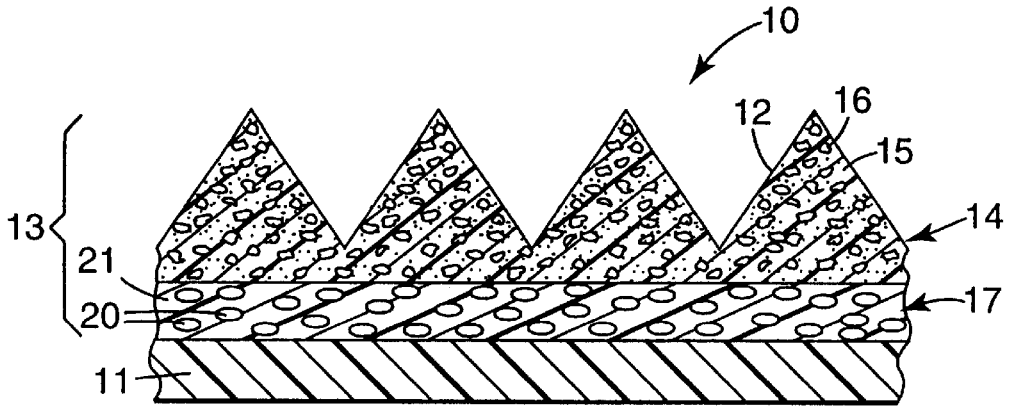
FIG. 1 is a cross sectional view of one abrasive article made in accordance with this invention.

As shown in FIG. 1, an abrasive article 10 of the present invention has a backing 11 and a thick abrasive coating 13. The thick abrasive coating contains a first abrasive composite layer 14 that comprises a plurality of first abrasive particles 16 distributed in a first binder 15. The first abrasive composite layer 14 includes an array of precisely shaped abrasive composite structures 12. A second abrasive composite layer 17 is coextensive with and interposed between the first abrasive composite layer 14 and the backing 11. The second abrasive composite layer 17 comprises a plurality of second abrasive particles 20 distributed in a second binder 21, and the second abrasive composite layer 17 is substantially free of an array of shaped abrasive composite structures. The term "coextensive" indicates that a component of the abrasive article is generally continuous with and parallel to one or more components of the abrasive article. A "thick abrasive coating" refers to a coating having a plurality of abrasive composite layers each having undergone, at least one curing process.

Figure 2:
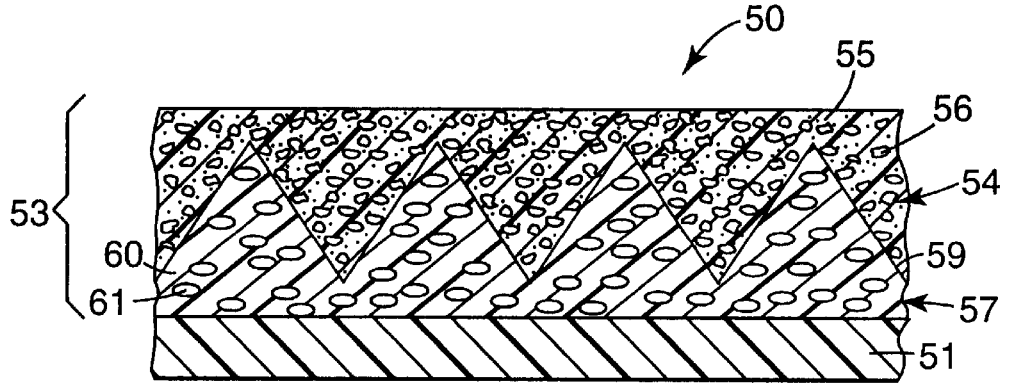
FIG. 2 is a cross sectional view of another abrasive article made in accordance with this invention.

FIG. 2 illustrates a second example of an abrasive article 50 of the present invention with a thick abrasive coating 53. The thick abrasive coating contains a first abrasive composite layer 54 with a plurality of first abrasive particles 56 distributed in a first binder 55. The first abrasive composite layer is substantially free of an array of shaped abrasive composite structures. The first abrasive composite layer 54 does not independently include an array of shaped abrasive composite structures but instead follows the contours associated with the second abrasive composite layer 57. A second abrasive composite layer 57 includes an array of precisely shaped abrasive composite structures 59 and is coextensive with and interposed between the first abrasive composite layer 54 and the backing 51. The second abrasive composite layer 57 comprises a plurality of second abrasive particles 61 dispersed in a second binder 60.

Figure 3:
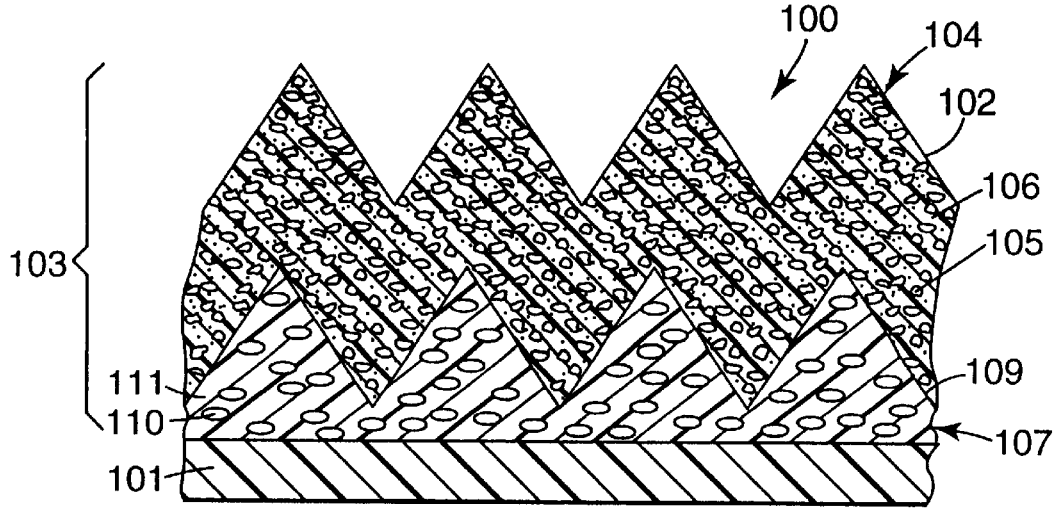
FIG. 3 is a cross sectional view of still another abrasive article made in accordance with this invention.

FIG. 3, illustrates a third example of an abrasive article 100 of the present invention wherein two abrasive composite layers of the abrasive coating 103 include an array of precisely shaped abrasive composite structures. The abrasive article has a backing 101 and a first abrasive composite layer 104 comprising a plurality of abrasive particles 106 distributed in a binder 105. The first abrasive composite layer 104 includes an array of precisely shaped abrasive composite structures 102. A second abrasive composite layer 107 is coextensive with and interposed between the first abrasive composite layer 104 and the backing 101. The second abrasive composite layer 107 comprises a plurality of abrasive particles 110 distributed in a binder 111 and includes an array of precisely shaped abrasive composite structures 109 independent of the first abrasive composite layer 104.

The figures illustrate examples of abrasive articles containing a thick abrasive coating having two abrasive composite layers where each abrasive composite layer comprises a plurality of abrasive particles dispersed in a binder. Some abrasive articles of the present invention may contain abrasive composite layers that have identical components, while other abrasive composite layers of the article may not have any components in common. For example, abrasive particles may vary in size, shape, and physical characteristics. An abrasive article having one abrasive composite layer with abrasive particles of one specific size may have another abrasive composite layer with abrasive particles of a different size. Typically, the abrasive particle is chosen based on the intended surface finish to be provided on a particular workpiece. If the abrasive article is to be used for generating a fine finish on the surface of a workpiece, then an abrasive article with small sized abrasive particles are typically chosen for use in a particular surface modification process. An abrasive article of this invention may contain abrasive composite layers where all layers, or just some of the layers, are free of abrasive particles. An abrasive article used in a surface modification process having significant abrading action (high stock removal) typically will have an abrasive coating with abrasive particles of relatively large size. The articles of the present invention may be used in a wide variety of surface modification processes and therefore may contain many different types of abrasive composite layers suitable for any particular surface modification process.

The invention also encompasses abrasive articles with many different shaped abrasive composite layers. One example of an abrasive article of the present invention may be an abrasive article having more than two abrasive composite layers wherein each of the abrasive composite layers forms an array of shaped, preferably precisely shaped, abrasive composite structures. The composite structures of some or all abrasive composite layers of an abrasive article may be the same shape, or different shapes. The shape of the abrasive composite structure of each layer of an abrasive article of the present invention maybe precisely shaped or irregularly shaped.

There were few reports, if any, on the ability of an abrasive composite layer to withstand multiple curing processes. The abrasive articles of the present invention comprise abrasive composite layers wherein at least one layer has undergone at least two, possibly different, curing steps. As mentioned, an abrasive composite layer is applied to an abrasive article in the form of a curable abrasive composite layer that becomes cured by a curing process that typically involves radiation or thermal energy. Each time a curable abrasive composite layer is applied to a previous cured abrasive composite layer, the previously cured abrasive composite layer undergoes an additional curing step. If an abrasive article of the present invention has four abrasive composite layers, than the first abrasive composite layer provided on the backing may undergo four curing processes. The present invention illustrates that a single abrasive composite layer may undergo more than one curing step without cracking or disassociating from a surface.

In addition to being suitable for surface modification processes, the abrasive articles of the present invention have enhanced durability. These articles are capable of being used in a large number of surface modification processes, or in one surface modification process for a long period of time. The length of time an abrasive article may be used in a surface modification process may be determined by measuring how long it takes for the abrasive coating to be removed from the backing of an abrasive article. An abrasive coating of the present invention becomes essentially eroded when the backing of the abrasive article is essentially all that remains on the abrasive article. At the point in time, the article is no longer suitable for use in future surface modification processes.

Each abrasive composite layer includes components important to surface modification characteristics and the durability of an abrasive article. The components of the abrasive composite layers and other embodiments of the invention are discussed in the following sections of the patent application.

Abrasive Particles

An abrasive article of the present invention typically comprises at least one abrasive composite layer that includes a plurality of abrasive particles dispersed in precursor polymer subunits. The abrasive particles may be uniformly dispersed in precursor polymer subunits or alternatively the abrasive particles may be non-uniformly dispersed. It is preferred that the abrasive particles are uniformly dispersed so that the resulting abrasive article has a more consistent cutting ability.

The average particle size of the abrasive particles can range from about 0.01 to 1500 micrometers, typically between 0.01 and 500 micrometers, and most generally between 15 and 500 micrometers. The size of the abrasive particle is typically specified to be the longest dimension of the abrasive particle. In most cases there will be a range distribution of particle sizes. In some instances it is preferred that the particle size distribution be tightly controlled such that the resulting abrasive article provides a consistent surface finish on the workpiece being abraded.

Examples of conventional hard abrasive particles include fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel abrasive particles and the like. Examples of sol gel abrasive particles can be found in U.S. Pat. Nos. 4,314,827 (Leitheiser et al.); 4,623,364 (Cottringer et al); 4,744,802 (Schwabel); 4,770,671 (Monroe et al.) and 4,881,951 (Wood et al.), all incorporated herein after by reference.

The term abrasive particle, as used herein, also encompasses single abrasive particles bonded together with a polymer to form an abrasive agglomerate. Abrasive agglomerates are further described in U.S. Pat. Nos. 4,311,489 (Kressner); 4,652,275 (Bloecher et al.); 4,799,939 (Bloecher et al.), and 5,500,273 (Holmes et al.). Alternatively, the abrasive particles may be bonded together by inter particle attractive forces.

The abrasive particle may also have a shape associated with it. Examples of such shapes include rods, triangles, pyramids, cones, solid spheres, hollow spheres and the like. Alternatively, the abrasive particle may be randomly shaped.

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. Nos. 5,011,508 (Wald et al.); 1,910,444 (Nicholson); 3,041,156 (Rowse et al.); 5,009,675 (Kunz et al.); 4,997,461 (Markhoff-Matheny et al.); 5,213,951 (Celikkaya et al.); 5,085,671 (Martin et al.) and 5,042,991 (Kunz et al.), the disclosures of which are incorporated herein by reference.

It is generally preferred to incorporate abrasive particles into the abrasive composite layer; though in some instances, an abrasive composite layer comprising shaped abrasive composites may not comprise abrasive particles. An abrasive article with an abrasive composite layer substantially free of abrasive particles is especially designed for polishing "soft" workpieces such as painted surfaces, wood, stained wood, lacquers, plastics and the like. It is within the scope of this invention to have an abrasive article including at least one abrasive composite layer substantially free of abrasive particles. Alternatively, an abrasive article of this invention may contain abrasive composite layers wherein all layers are substantially free of abrasive particles. Abrasive composite layers independent of whether or not they are substantially free of abrasive particles, may also comprise filler particles or other additives. Because the above abrasive articles of this invention have two or more abrasive composite layers, it is within the scope of this invention to have an abrasive article with one abrasive composite layer substantially free of abrasive particles and a second abrasive layer comprising abrasive particles.

Fillers

An abrasive article of this invention may comprise an abrasive coating which further comprises a filler. A filler is a particulate material with an average particle size range between 0.1 to 50 micrometers, typically between 1 to 30 micrometers. Examples of useful fillers for this invention include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides and suspending agents.

An example of a suspending agent is an amorphous silica particle having a surface area less than 150 meters square/gram that is commercially available from DeGussa Corp., under the trade name "OX-50". The addition of the suspending agent can lower the overall viscosity of the abrasive slurry. The use of suspending agents is further described in U.S. Pat. No. 5,368,619, incorporated herein after by reference.

Binders

The abrasive coating of this invention is formed from a curable abrasive composite layer that comprise a mixture of abrasive particles and precursor polymer subunits. The curable abrasive composite layer preferably comprises organic precursor polymer subunits. The precursor polymer subunits preferably are capable of flowing sufficiently so as to be able to coat a surface. Solidification of the precursor polymer subunits may be achieved by curing (e.g., polymerization and/or cross-liking), by drying (e.g., driving off a liquid) and/or simply by cooling. The precursor polymer subunits may be an organic solvent borne, a water-borne, or a 100% solids (i.e., a substantially solvent-free) composition. Both thermoplastic and/or thermosetting polymers, or materials, as well as combinations thereof, maybe used as precursor polymer subunits. Upon the curing of the precursor polymer subunits, the curable abrasive composite is converted into the cured abrasive composite. The preferred precursor polymer subunits can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

An abrasive composite layer may comprise by weight, 100% precursor polymer subunits, between about 1 part abrasive particles to 90 parts abrasive particles and 10 parts precursor polymer subunits to 99 parts precursor polymer subunits. Preferably, an abrasive composite layer may comprise about 30 to 85 parts abrasive particles and about 15 to 70 parts precursor polymer subunits. More preferably an abrasive composite layer may comprise about 40 to 70 parts abrasive particles and about 30 to 60 parts precursor polymer subunits.

The precursor polymer subunits are preferably a curable organic material (i.e., a polymer subunit or material capable of polymerizing and/or crosslinkng upon exposure to heat and/or other sources of energy, such as electron beam, ultraviolet light, visible light, etc., or with time upon the addition of a chemical catalyst, moisture, or other agent which cause the polymer to cure or polymerize). Precursor polymer subunits examples include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast precursor polymer subunits have at least one pendant alpha, beta-unsaturated carbonyl group per molecule or oligomer. These polymer materials are further described in U.S. Pat. Nos. 4,903,440 (Larson et al.) and 5,236,472 (Kirk et al.), both incorporated herein by reference.

Preferred cured abrasive composites are generated from free radical curable precursor polymer subunits. These precursor polymer subunits are capable of polymerizing rapidly upon an exposure to thermal energy and/or radiation energy. One preferred subset of free radical curable precursor polymer subunits include ethylenically unsaturated precursor polymer subunits. Examples of such ethylenically unsaturated precursor polymer subunits include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof The term acrylate includes both acrylates and methacrylates.

Ethylenically unsaturated precursor polymer subunits include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers. Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobomyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2 (2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, or N-vinylpiperidone.

A preferred precursor polymer subunits contains a blend of two or more acrylate monomers. For example, the precursor polymer subunits may be a blend of trifunctional acrylate and a monofunctional acrylate monomers. An example of one precursor polymer subunits is a blend of propoxylated trimethylol propane triacrylate and 2 (2-ethoxyethoxy) ethyl acrylate. The weight ratios of multifunctional acrylate and monofunctional acrylate polymers may range from about 1 part to about 90 parts multifunctional acrylate to about 10 parts to about 99 parts monofunctional acrylate.

It is also feasible to formulate a precursor polymer subunits from a mixture of an acrylate and an epoxy polymer, e.g., as described in U.S. Pat. No. 4,751,138 (Tumey et al.), incorporated herein by reference.

Other precursor polymer subunits include isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris (hydroxyethyl) isocyanurate.

Still other precursor polymer subunits include diacrylate urethane esters as well as polyacrylate or poly methacrylate urethane esters of hydroxy terminated isocyanate extended polyesters or polyethers. Examples of commercially available acrylated urethanes include those under the tradename "UVITHANE 782", available from Morton Chemical; "CMD 6600", "CMD 8400", and "CMD 8805", available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other precursor polymer subunits include diacrylate epoxy esters as well as polyacrylate or poly methacrylate epoxy ester such as the diacrylate esters of bisphenol A epoxy polymer. Examples of commercially available acrylated epoxies include those under the tradename "CMD 3500", "CMD 3600", and "CMD 3700", available from UCB Radcure Specialties.

Other precursor polymer subunits may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred precursor polymer subunits is a blend of ethylenically unsaturated oligomer and monomers. For example the precursor polymer subunits may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof The precursor polymer subunits may also be an acrylate dispersion like that described in U.S. Pat. No. 5,378,252 (Follensbee), incorporated herein by reference.

In addition to thermosetting polymers, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof Water-soluble precursor polymer subunits optionally blended with a thermosetting resin may be used. Examples of water-soluble precursor polymer subunits include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.), incorporated herein by reference.

In the case of precursor polymer subunits containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof Examples of suitable commercially available, ultraviolet-activated photoinitiators have tradenames such as "IRGACURE 651" and "IRGACURE 184" commercially available from the Ciba Geigy Company and "DAROCUR 1173" commercially available from Merck. Another visible light-activated photoinitiator has the trade name "IRGACURE 369" commercially available from Ciba Geigy Company. Examples of suitable visible light-activated initiators are reported in U.S. Pat. Nos. 4,735,632 (Oxman et al.) and 5,674,122 (Kiun et al.).

A suitable initiator system may include a photosensitizer. Representative photosensitizers may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX", "QUANTICURE QTX", "QUANTICURE PTX", "QUANTICURE EPD" from Biddle Sawyer Corp.

In general, the amount of photosensitizer or photoinitiator system may vary from about 0.01 to 10% by weight, more preferably from 0.25 to 4.0% by weight of the components of the precursor polymer subunits.

Additionally, it is preferred to disperse (preferably uniformly) the initiator in the precursor polymer subunits before addition of any particulate material, such as the abrasive particles and/or filler particles.

In general, it is preferred that the precursor polymer subunits be exposed to radiation energy, preferably ultraviolet light or visible light, to cure or polymerize the precursor polymer subunits. In some instances, certain abrasive particles and/or certain additives will absorb ultraviolet and visible light, which may hinder proper cure of the precursor polymer subunits. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyldiphenylphosphine oxide, which is commercially available from BASF Corporation under the trade designation "LR8893". Other examples of commercially available acylphosphine oxides include "Darocur 4263" and "Darocur 4265" commercially available from Merck.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. Nos. 4,751,138 (Tumey et al.); 5,256,170 (Harmer et al.); 4,985,340 (Palazotto); and 4,950,696, all incorporated herein by reference.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

An Abrasive Composite Layer

An abrasive composite layer of this invention typically comprises a plurality of abrasive particles fixed and dispersed in precursor polymer subunits, but may include other additives such as coupling agents, fillers, expanding agents, fibers, antistatic agents, initiators, suspending agents, photosensitizers, lubricants, wetting agents, surfactants, pigments, dyes, UV stabilizers and suspending agents. The amounts of these additives are selected to provide the properties desired.

The abrasive composite may optionally include a plasticizer. In general, the addition of the plasticizer will increase the erodibility of the abrasive composite and soften the overall binder composition. In some instances, the plasticizer will act as a diluent for the precursor polymer subunits. The plasticizer is preferably compatible with the precursor polymer subunits to minimize phase separation. Examples of suitable plasticizers include polyethylene glycol, polyvinyl chloride, dibutyl phthalate, alkyl benzyl phthalate, polyvinyl acetate, polyvinyl alcohol, cellulose esters, silicone oils, adipate and sebacate esters, polyols, polyols derivatives, t-butylphenyl diphenyl phosphate, tricresyl phosphate, castor oil, or combinations thereof Phthalate derivatives are one type of preferred plasticizers.

The abrasive particle, or abrasive coating, may further comprise surface modification additives include wetting agents (also sometimes referred to as surfactants) and coupling agents. A coupling agent can provide an association bridge between the precursor polymer subunits and the abrasive particles. Additionally, the coupling agent can provide an association bridge between the binder and the filler particles. Examples of coupling agents include silanes, titanates, and zircoaluminates.

In addition, water and/or organic solvent may be incorporated into the abrasive composite. The amount of water and/or organic solvent is selected to achieve the desired coating viscosity of precursor polymer subunits and abrasive particles. In general, the water and/or organic solvent should be compatible with the precursor polymer subunits. The water and/or solvent may be removed following polymerization of the precursor, or it may remain with the abrasive composite. Suitable water soluble and/or water sensitive additives include polyvinyl alcohol, polyvinyl acetate, or cellulosic based particles.

Examples of ethylenically unsaturated diluents or monomers can be found in U.S. Pat. No. 5,236,472 (Kirk et al.), incorporated herein by reference. In some instances these ethylenically unsaturated diluents are useful because they tend to be compatible with water. Additional reactive diluents are disclosed in U.S. Pat. No. 5,178,646 (Barber et al.), incorporated herein by reference.

Abrasive Composite Structure Configuration

An abrasive article of this invention contains an abrasive coat with at least one abrasive composite layer that includes an array of shaped, preferably precisely shaped, abrasive composite structures. The term "shaped" in combination with the term "abrasive composite structure" refers to both "precisely shaped" and "irregularly shaped" abrasive composite structures. An abrasive article of this invention may contain a plurality of such shaped abrasive composite structures in a predetermined array on a backing. An abrasive composite structure can be formed, for example, by curing the precursor polymer subunits while being borne on the backing and in the cavities of the production tool.

The shape of the abrasive composites structures may be any of a variety of geometric configurations. Typically the base of the shape in contact with the backing has a larger surface area than the distal end of the composite structure. The shape of the abrasive composite structure may be selected from among a number of geometric solids such as a cubic, cylindrical, prismatic, right parallelepiped, pyramidal, truncated pyramidal, conical, hemispherical, truncated conical, or posts having any cross section. Generally, shaped composites having a pyramidal structure have three, four, five or six sides, not including the base. The cross-sectional shape of the abrasive composite structure at the base may differ from the cross-sectional shape at the distal end. The transition between these shapes may be smooth and continuous or may occur in discrete steps. The abrasive composite structures may also have a mixture of different shapes. The abrasive composite structures may be arranged in rows, spiral, helix, or lattice fashion, or may be randomly placed.

The sides forming the abrasive composite structures may be perpendicular relative to the backing, tilted relative to the backing or tapered with diminishing width toward the distal end. An abrasive composite structure with a cross section that is larger at the distal end than at the back may also be used, although fabrication may be more difficult.

The height of each abrasive composite structure is preferably the same, but it is possible to have composite structures of varying heights in a single fixed abrasive article. The height of the composite structures generally may be less than about 2000 micrometers, and more particularly in the range of about 25 to 1000 micrometers. The diameter or cross sectional width of the abrasive composite structure can range from about 5 to 500 micrometers, and typically between about 10 to 250 micrometers.

The base of the abrasive composite structures may abut one another or, alternatively, the bases of adjacent abrasive composites may be separated from one another by some specified distance.

The linear spacing of the abrasive composite structures may range from about 1 to 12,000 composites/$cm^2$ and preferably at least about 50 to 7,5000 abrasive composite structures/$cm^2$. The linear spacing may be varied such that the concentration of composite structures is greater in one location than in another. The area spacing of composite structures ranges from about 1 abrasive composite structure per linear cm to about 100 abrasive composite structures per linear cm and preferably between about 5 abrasive composite structures per linear cm to about 80 abrasive composites per linear cm.

The shaped abrasive composite structures are preferably set out on a backing, or a previously cured abrasive composite layer, in a predetermined pattern. Generally, the predetermined pattern of the abrasive composite structures will correspond to the pattern of the cavities on the production tool. The pattern is thus reproducible from article to article.

In one embodiment, an abrasive article of the present invention may contain abrasive composite structures in an array. With respect to a single abrasive composite layer, a regular array refers to aligned rows and columns of abrasive composite structures. In another embodiment, the abrasive composite structures may be set out in a "random" array or pattern. By this it is meant that the abrasive composite structures are not aligned in specific rows and columns. For example, the abrasive composite structures may be set out in a manner as described WO PCT 95/22436 published Aug. 24, 1995 (Hoopman et al.). It is understood, however, that this "random" array is a predetermined pattern in that the location of the composites is predetermined and corresponds to the location of the cavities in the production tool used to make the abrasive article. The term "array" refers to both "random" and "regular" arrays.

Backing

A variety of backing materials are suitable for the abrasive article of the present invention, including both flexible backings and backings that are more rigid. Examples of typical flexible abrasive backings include polymeric film, primed polymeric film, metal foil, cloth, paper, vulcanized fiber, nonwovens and treated versions thereof and combinations thereof The thickness of a backing generally ranges between about 20 to 5000 micrometers and preferably between 50 to 2500 micrometers.

Examples of more rigid backings include metal plates, ceramic plates, and the like. Another example of a suitable backing is described in U.S. Pat. No. 5,417,726 (Stout et al.) incorporated herein by reference. The backing may also consist of two or more backings laminated together, as well as reinforcing fibers engulfed in a polymeric material as disclosed in PCT publication WO 93/12911 (Benedict et al.).

Production Tool

A production tool is used to provide an abrasive composite layer with an array of either precisely or irregularly shaped abrasive composite structures. A production tool has a surface containing a plurality of cavities extending out of the main plane. These cavities are essentially the inverse shape of the abrasive composite structures and are responsible for generating the shape and placement of the abrasive composite structures. These cavities may have any geometric shape that is the inverse shape to the geometric shapes suitable for the abrasive composites. Preferably, the shape of the cavities is selected such that the surface area of the abrasive composite structure decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as photolithography, knurling, engraving, hobbing, electroforming, diamond turning, and the like. Preferred methods of making metal master tools are described in both PCT Publication WO 97/12727 and U.S. patent application Ser. No. 08/894,978 (Hoopman) filed Sep. 3, 1997.

A thermoplastic tool can be replicated off a metal master tool. The master tool will have the inverse pattern desired for the production tool. The master tool is preferably made out of metal,. e.g., a nickel-plated metal such as aluminum, copper or bronze. A thermoplastic sheet material optionally can be heated along with the master tool such that the thermoplastic material is embossed with the master tool pattern by pressing the two together. The thermoplastic material can also be extruded or cast onto the master tool and then pressed. The thermoplastic material is cooled to a nonflowable state and then separated from the master tool to produce a production tool. The production tool may also contain a release coating to permit easier release of the abrasive article from the production tool. Examples of such release coatings include silicones and fluorochemicals.

Suitable thermoplastic production tools are reported in U.S. Pat. No. 5,435,816 (Spurgeon et al.), incorporated herein by reference. Examples of thermoplastic materials useful to form the production tool include polyesters, polypropylene, polyethylene, polyamides, polyurethanes, polycarbonates, or combinations thereof It is preferred that the thermoplastic production tool contain additives such as anti-oxidants and/or UV stabilizers. These additives may extend the useful life of the production tool. The production tool may also contain a release coating to permit easier release of the fixed abrasive article from the production tool. Examples of such release coatings include silicones and fluorochemicals.

Method for Making An Abrasive Article

A preferred method for making an abrasive article with one abrasive composite layer having precisely shaped abrasive composite structures is described in U.S. Pat. Nos. 5,152,917 (Pieper et al) and 5,435,816 (Spurgeon et al.), both incorporated herein by reference. Other descriptions of suitable methods are reported in U.S. Pat. Nos. 5,437,754; 5,454,844 (Hibbard et al.); 5,437,7543 (Calhoun); and 5,304,223 (Pieper et al.), all incorporated herein by reference.

A suitable method for preparing an abrasive composite layer having an array of shaped abrasive composite structures includes preparing a curable abrasive composite layer comprising abrasive particles, precursor polymer subunits and optional additives; providing a production tool having a front surface; introducing the curable abrasive composite layer into the cavities of a production tool having a plurality of cavities; introducing a backing or previously cured abrasive composite layer of an abrasive article to the curable abrasive composite layer; and curing the curable abrasive composite layer before the article departs from the cavities of the production tool to form a cured abrasive composite layer comprising abrasive composite structures. The curable abrasive composite is applied to the production so that the thickness of the curable abrasive composite layer is less than or equal to its practical thickness limit.

An abrasive composite layer that is substantially free of an array of precisely shaped abrasive composite structures is made by placing a curable abrasive composite layer on a backing, or previously cured abrasive composite layers, independently of a production tool, and curing the abrasive composite layer to form a cured abrasive composite layer. The curable abrasive composite layer is applied to a surface so that the thickness of the abrasive composite layer is less than or equal to its practical thickness limit. Additional abrasive composite layers may be added to an abrasive article by repeating the above steps.

The curable abrasive composite layer is made by combining together by any suitable mixing technique the precursor polymer subunits, the abrasive particles and the optional additives. Examples of mixing techniques include low shear and high shear mixing, with high shear mixing being preferred. Ultrasonic energy may also be utilized in combination with the mixing step to lower the curable abrasive composite viscosity (the viscosity being important in the manufacture of the an abrasive article) and/or affect the rheology of the resulting curable abrasive composite layer. Alternatively, the curable abrasive composite layer may be heated in the range of 30 to 70° C., microfluidized or ball mllled in order to mix the curable abrasive composite.

Typically, the abrasive particles are gradually added into the precursor polymer subunits. It is preferred that the curable abrasive composite layer be a homogeneous mixture of precursor polymer subunits, abrasive particles and optional additives. If necessary, water and/or solvent is added to lower the viscosity. The formation of air bubbles may be minimized by pulling a vacuum either during or after the mixing step.

The coating station can be any conventional coating means such as drop die coater, knife coater, curtain coater, vacuum die coater or a die coater. A preferred coating technique is a vacuum fluid bearing die reported in U.S. Pat. Nos. 3,594,865; 4,959,265 (Wood); and 5,077,870 (Millage), which are incorporated herein by reference. During coating, the formation of air bubbles is preferably minimized.

After the production tool is coated, the backing, or previously cured abrasive composite layer of an abrasive article, and the next layer of curable abrasive composite is brought into contact by any means such that the next layer of curable abrasive composite wets a surface of the backing or previously cured abrasive composite layer. The curable abrasive composite layer is brought into contact with the backing or the previously cured abrasive composite layer by contacting the nip roll which forces the resulting construction together. The nip roll may be made from any material; however, the nip roll is preferably made from a structural material such as metal, metal alloys, rubber or ceramics. The hardness of the nip roll may vary from about 30 to 120 durometer, preferably about 60 to 100 durometer, and more preferably about 90 durometer.

Next, energy is transmitted into the curable abrasive composite layer by an energy source to at least partially cure the precursor polymer subunits. The selection of the energy source will depend in part upon the chemistry of the precursor polymer subunits, the type of production tool as well as other processing conditions. The energy source should not appreciably degrade the production tool or backing. Partial cure of the precursor polymer subunits means that the precursor polymer subunits is polymerized to such a state that the curable abrasive composite layer does not flow when inverted in the production tool. If needed, the precursor polymer subunits may be fully cured after it is removed from the production tool using conventional energy sources.

After at least partial cure of the precursor polymer subunits, the production tool and abrasive article are separated. If the precursor polymer subunits are not essentially fully cured, the precursor polymer subunits can then be essentially fully cured by either time and/or exposure to an energy source. Finally, the production tool is rewound on a mandrel so that the production tool can be reused again and the fixed abrasive article is wound on another mandrel.

In another variation of this first method, the curable abrasive composite layer is coated onto the backing and not into the cavities of the production tool. The curable abrasive composite layer coated backing is then brought into contact with the production tool such that the slurry flows into the cavities of the production tool. The remaining steps to make the abrasive article are the same as detailed above.

It is preferred that the precursor polymer subunits are cured by radiation energy. The radiation energy may be transmitted through the backing or through the production tool. The backing or production tool should not appreciably absorb the radiation energy. Additionally, the radiation energy source should not appreciably degrade the backing or production tool. For instance, ultraviolet light can be transmitted through a polyester backing. Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light may be transmitted through the production tool and into the slurry. For thermoplastic based production tools, the operating conditions for making the fixed abrasive article should be set such that excessive heat is not generated. If excessive heat is generated, this may distort or melt the thermoplastic tooling.

The energy source may be a source of thermal energy or radiation energy, such as electron beam, ultraviolet light, or visible light. The amount of energy required depends on the chemical nature of the reactive groups in the precursor polymer subunits, as well as upon the thickness and density of the binder slurry. For thermal energy, an oven temperature of from about 50° C. to about 250° C. and a duration of from about 15 minutes to about 16 hours are generally sufficient. Electron beam radiation or ionizing radiation may be used at an energy level of about 0.1 to about 10 Mrad, preferably at an energy level of about 1 to about 10 Mrad. Ultraviolet radiation includes radiation having a wavelength within a range of about 200 to about 400 nanometers, preferably within a range of about 250 to 400 nanometers. Visible radiation includes radiation having a wavelength within a range of about 400 to about 800 nanometers, preferably in a range of about 400 to about 550 nanometers.

The resulting cured abrasive composite layer will have the inverse pattern of the production tool. By at least partially curing or curing on the production tool, the abrasive composite layer has a precise and predetermined pattern.

There are many methods for making abrasive composites having irregularly shaped abrasive composites. While being irregularly shaped, these abrasive composites may nonetheless be set out in a predetermined pattern, in that the location of the composites is predetermined. In one method, curable abrasive composite is coated so that the thickness of the abrasive composite layer is within the practical thickness limits of the composite, into cavities of a production tool to generate the abrasive composites. The production tool may be the same production tool as described above in the case of precisely shaped composites. However, the curable abrasive composite layer is removed from the production tool before the precursor polymer subunits is cured sufficiently for it to substantially retain its shape upon removal from the production tool. Subsequent to this, the precursor polymer subunits is cured. Since the precursor polymer subunits is not cured while in the cavities of the production tool, this results in the curable abrasive composite layer flowing and distorting the abrasive composite shape.

In another method of making irregularly shaped composites, the curable abrasive composite can be coated onto the surface of a rotogravure roll. The backing comes into contact with the rotogravure roll and the curable abrasive composite wets the backing. The rotogravure roll then imparts a pattern or texture into the curable abrasive composite. Next, the slurry/backing combination is removed from the rotogravure roll and the resulting construction is exposed to conditions to cure the precursor polymer subunits such that an abrasive composite is formed. A variation of this process is to coat the curable abrasive composite onto the backing and bring the backing into contact with the rotogravure roll.

The rotogravure roll may impart desired patterns such as a hexagonal array, ridges, lattices, spheres, pyramids, truncated pyramids, cones, cubes, blocks, or rods. The rotogravure roll may also impart a pattern such that there is a land area between adjacent abrasive composites. This land area can comprise a mixture of abrasive particles and binder. Alternatively, the rotogravure roll can impart a pattern such that the backing is exposed between adjacent abrasive composite shapes. Similarly, the rotogravure roll can impart a pattern such that there is a mixture of abrasive composite shapes.

Another method is to spray or coat the curable abrasive composite layer through a screen to generate a pattern and the abrasive composites. Then the precursor polymer subunits are cured to form the abrasive composite structures. The screen can impart any desired pattern such as a hexagonal array, ridges, lattices, spheres, pyramids, truncated pyramids, cones, cubes, blocks, or rods. The screen may also impart a pattern such that there is a land area between adjacent abrasive composite structures. This land area can comprise a mixture of abrasive particles and binder. Alternatively, the screen may impart a pattern such that the backing is exposed between adjacent abrasive composite structures. Similarly, the screen may impart a pattern such that there is a mixture of abrasive composite shapes. This process is reported in U.S. Pat. No. 3,605,349 (Anthon), incorporated herein by reference.

EXAMPLES

The following non-limiting examples will further illustrate the invention. All parts, percentages, ratios, etc., in the examples are by weight unless otherwise indicated. The following abbreviations are used throughout:

TABLE 1

| Designation | Material |
|---|---|
| AO | fused aluminum oxide abrasive grain; |
| ASF | amorphous silica filler, commercially available from DeGussa Corp. under the trade designation "OX-50"; |
| CMSK | treated calcium metasilicate filler, commercially available from NYCO, Willsboro, NY under the trade designation "WOLLASTOCOAT"; |
| KB1 | 2,2-dimethoxy-1,2-diphenylethanone, commerically available from Lamberti S.P.A. (through Sartomer Co.) under the trade designation "ESACURE KB 1"; |
| KBF4 | potassium tetrafluoroborate; |
| PH2 | 2-benzyl-2-N,N-dimethylamino-1-(4-morpholinophenyl)-1-butanone, commercially available from Ciba-Geigy Corp. under the trade designation "IRGACURE 369"; |
| PRO | a mixture of 60/40/1 TMPTA/TATHEIC/KB1; |
| SCA | silane coupling agent, 3-methacryloxypropyl-trimethoxy-silane, commercially available from Union Carbide under the trade designation "A-174"; |
| TATHEIC | triacrylate of tris(hydroxy ethyl)isocyanurate, commercially available from Sartomer Co., under the trade designation "SR368"; |
| TMPTA | trimethylol propane triacrylate, commercially available from Sartomer under the trade designation "SR351". |

The following general procedures were used to make the abrasive coatings of the abrasive articles used in Examples 1–11 and Comparative Examples B–D.

General Procedure I For Making An Abrasive Article

First, a curable abrasive composite, comprising precursor polymer subunits, was prepared by thoroughly mixing materials as listed in the examples in a high shear mixer.

The abrasive article was made using a polypropylene production tool that comprised a series of cavities with specified dimensions arranged in a predetermined order or array as described in the examples. The production tool was essentially the inverse of the desired shape, dimensions and arrangement of the abrasive composite structures. The production tool was unwound from a winder and the curable abrasive composite layer was coated into the cavities of the production tool at a speed of about 15.2 meters/minute (50 ft/min) with a knife coater at approximately 32° C. The knife coater had a gap of approximately 75–100 micrometers (3–4 mils). Next, a 406 micrometer (16 mil) thick polyester-cotton cloth backing having a latex/phenolic cloth treatment was brought into contact with the curable abrasive composite layer coated production tool such that the curable abrasive composite layer wetted the front surface of the backing. Afterwards, ultraviolet light radiation was transmitted through the production tool and into the curable abrasive composite layer. The ultraviolet lamp used was a Fusion System ultraviolet light that used 2 "D" bulbs and operated at a dosage of about 236.2 Watts/cm (600 Watts/inch). Upon exposure to the ultraviolet light, the precursor polymer subunits were converted into an essentially cured abrasive composite layer. It is difficult to obtain complete curing of the abrasive composite layer wherein 100% of all polymer precursor subunits are incorporated into a larger polymer. Consequently, a cured abrasive composite layer is an abrasive composite layer that has undergone a curing process and has been essentially cured in that all most all of the precursor polymer subunits have been incorporated into a larger polymer chain. Only a residue of unincorporated precursor polymer subunits remains in the cured abrasive composite layer after the curing process. The production tool was removed from the abrasive composite/backing and the abrasive article was wound on a take-up roll.

A second abrasive composite layer was applied directly on top of this first abrasive composite layer by the same procedure.

General Procedure II For Making An Abrasive Article

First, a curable abrasive composite layer, comprising precursor polymer subunits, was prepared by thoroughly mixing the raw materials as listed in the examples in a high shear mixer.

The abrasive article was made by coating the curable abrasive composite layer onto a polyester-cotton cloth backing having a latex/phenolic cloth treatment. The curable abrasive composite layer was applied to the backing at a speed of about 15.2 meters/minute (50 ft/min) with a knife coater. The knife coater had a gap of approximately 228–305 micrometers (9–12 mils).

Next, a polypropylene production tool, that comprised a series of cavities with specified dimensions arranged in a predetermined order or array as specified in the examples, having essentially the inverse of the desired shape, dimension and arrangement of the abrasive composites was brought into contact with the backing by means of a roller so that the curable abrasive composite layer filled the cavities of the production tool. Afterwards, ultraviolet light radiation was transmitted through the production tool and into the curable abrasive composite layer. The ultraviolet lamp used was a Fusion System ultraviolet light that used 2 "D" bulbs and operated at a dosage of about 236.2 Watts/cm (600 Watts/inch). Upon exposure to the ultraviolet light, the curable abrasive composite was converted into a cured abrasive composite layer. The abrasive composite layer was then removed from the cavities of the production tool and the abrasive article was wound on a take-up roll.

A second abrasive composite layer was applied directly on top of this first abrasive composite layer by the same procedure. It should be noted that an abrasive article made under this patent may utilize General Procedure I for creating one or more abrasive composite layers and General Procedure II to create other additional abrasive composite layers. The abrasive composite layers of an abrasive coating may each be made by a different method. For example, methods including a rotogravure may be used to make one or more abrasive composite layers of an abrasive article of the present invention.

Test Procedure For Measuring The Durability of An Abrasive Article

The above methods General Procedure I and II For Making An Abrasive Article were used to produce coated webs of abrasive material. These webs were then converted into endless abrasive belts by techniques common to abrasive belt manufacturing. In this case, the abrasive belts measured 7.6 cm wide×203 cm long (3"×80"). The abrasive articles were tested on a constant infeed surface grinder to calculate the number of surface modification processes an abrasive article could endure before the abrasive coat of the abrasive article was essentially eroded; that is the backing was essentially completely exposed through the abrasive coating. The abrasive article was tested by mounting the article on a surface grinder. The surface grinder had a 45.72 cm (18 inch) smooth rubber 90 shore D durometer driven contact wheel. The abrasive article was driven at a speed of 1706 meters/minute (5600 ft/min) and a steel workpiece was incrementally pressed against the belts at 6.35 micrometers/pass (0.25 mil/pass) (i.e., downfeed) at a throughput speed of 6 meters/minute. The workpiece was a 1018 mild steel workpiece and positioned horizontally and reciprocated parallel to the belt. The test was run under a water flood and testing was ended when the backing of the abrasive article was essentially all that remained on the abrasive article, that is the abrasive coating of the abrasive article was essentially eroded. The durability of an abrasive article was correlated to the number of times the workpiece was pressed against the abrasive article before the abrasive coating was essentially eroded.

Production Tool

A production tool with an array of precisely shaped cavities was used to make an abrasive composite layer that includes an array of precisely shaped abrasive composite structures. Each abrasive composite structure of an abrasive composite layer was generally the inverse shape of the cavity. The following production tools were used:

Production Tool I: Production Tool I contained cavities that when applied to abrasive composite material, produced abrasive composite layers with precisely shaped "gumdrop" structures, as taught by PCT WO 95/22436. The base of a gumdrop cavity refers to the portion of the production tool defining the cavity that comes in contact with a backing during the curing process. The base diameter of a gumdrop shaped cavity on production tool I was about 329 μm to 381 μm. The depth of a gumdrop shaped cavity located on the production tool was measured from the center of the base to the highest point on the topography of the gumdrop shape. The average depth of a gumdrop shaped cavity of the production tool I was about 147 μm.

Production Tool II: Production Tool II contains cavities that when applied to abrasive composite material, produce abrasive composite layers with precisely shaped four sided pyramids of various sizes. The base of a pyramid shaped cavity of production tool II refers to the portion of the mold defining a pyramid shaped cavity that comes in contact with a backing during the curing process. The interior angles of a pyramid cavity formed at the base of the pyramid were within the range of 15° to 45°. The interior angle located at the highest point of a pyramid shaped cavity, that is the point furthest away from the center of the base, was in the range of 60° to 90°. The height of a pyramid shaped cavity measured from center of the base, to the highest point of the pyramid shaped cavity topography, was about 311 μm. The tool was produced by diamond turning according to the teachings of PCT WO 95/07797 (Hoopman et al.)

Production Tool III: Production Tool III contained cavities that when applied to abrasive composite material produce abrasive composite layers with precisely shaped four sided pyramids of various sizes. The structure of a pyramid shaped cavity was defined under Production Tool II. The interior angles located at the base of a pyramid shaped cavity located on production tool III were in the range of 30° to 45°. The interior angle located at the highest point of the pyramid topography of a cavity of production tool III was in the range of 60° to 90°. The depth of a pyramid cavity of production tool III, as defined above, was about 374 μm. The pyramid tool was produced by a cut knurling process according to the teachings of both PCT Publication WO 97/12727 and U.S. patent application Ser. No. 08,894,978 (Hoopman) filed Sep. 3, 1997.

Comparative Example A and Examples 1–6

The abrasive article of Comparative Example A is a structured abrasive belt having a single layer of precisely shaped abrasive composites, commercially available from Minnesota Mining and Manufacturing Co., (St. Paul, Minn.), herein after referred to as "3M", under the trade designation "TRIZACT 237AA".

The abrasive composite layers of Examples 1–4 were processed as described in General Procedure II For Making An Abrasive Article. The abrasive articles of Examples 5–6 were processed as described in General Procedure I For Making An Abrasive Article. The articles of Examples 1≧6 were made of the following components: 56.76 parts of a 70/30 blend TMPTA/TATHEIC, 39.17 parts KBF4, 2 parts SCA, 2 parts ASF and 0.57 parts pH2, and adding 58 parts AO (having an average particle size of about 80 micrometers) to 42 parts of the mixture.

The abrasive articles of Examples 1–6 had thick abrasive coatings containing two abrasive composite layers compared to the abrasive article of Comparative Example A which had a thin abrasive coating with a single abrasive composite layer. The abrasive articles of Examples 1–6 had a bottom abrasive composite layer and a top abrasive composite layer. The bottom abrasive composite layer was defined as the abrasive composite layer interposed between the top abrasive composite layer and the backing of the abrasive article. The articles of the comparative examples have only one abrasive composite layer, that is a bottom abrasive composite layer adjacent to a backing. Table 2 summarizes the resulting abrasive article construction by listing the production tools used for the first and second composite layers and the depths of the cavities in the production tools for Examples 1–6.

TABLE 2

CHARACTERISTICS OF ABRASIVE COMPOSITE LAYERS

| Abrasive Article | Bottom Layer | Top Layer |
|---|---|---|
| Example 1 | Production Tool I | Production Tool I |
| Example 2 | Production Tool I | Production Tool II |
| Example 3 | Production Tool II | Production Tool II |
| Example 4 | Production Tool II | Production Tool I |
| Example 5 | Production Tool III | Production Tool III |
| Example 6 | Production Tool III | Production Tool I |

The durability of the abrasive articles of Examples 1–6 and Comparative Example A were determined as described in the Test Procedure For Measuring The Durability of An Abrasive Article. The results are in Table 3.

TABLE 3

DURABILITY

| Abrasive Article | No. of Contacts Between the Workpiece and Abrasive Article |
|---|---|
| Example 1 | 602 |
| Example 2 | 522 |
| Example 3 | 707 |
| Example 4 | 744 |
| Example 5 | 412 |
| Example 6 | 450 |
| Comp. A | 191 |

The results illustrate that an abrasive article with a thick abrasive coating having at least two abrasive composite layers (Examples 1–6) was more durable than an abrasive article having a thin abrasive coating with a single abrasive composite layer. The abrasive article with a thick abrasive coating was able to contact the workpiece a larger number of times than an abrasive article with a thin abrasive coating, before the coating was essentially eroded.

Examples 7–9 & Comparative Examples B and C

The abrasive composite layers of Examples 7 and 8 and Comparative Examples B and C, were processed as described in General Procedure II For Making An Abrasive Article. The abrasive composite layers of Example 9 were processed as described in General Procedure I For Making An Abrasive Article. The articles of Examples 7, 8 and 9 and Comparative Examples B and C were made of the following components: 1000 parts PRO, 5 parts KBl, 35 parts SCA, 50 parts ASF, and 150 parts KBF4, and then 62 parts AO (having an average particle size of about 80 micrometers) were added to 38 parts of the precursor polymer subunits mixture.

Each of the abrasive articles of Examples 7, 8 and 9 had a thick abrasive coating that contained two abrasive composite layers. The bottom abrasive composite layer is defined as being interposed between the top abrasive composite layer and the backing of the abrasive article. The articles of the comparative examples have only one abrasive composite layer, that is a bottom abrasive composite layer adjacent to a backing. The abrasive articles of Comparative Examples B and C had a thin coating that contained only one abrasive composite layer. Table 4 summarizes the resulting abrasive article constructions by listing the production tools used for the bottom and top composite layers and the depths of the cavities in the production tools for Examples 7–9 and Comparative Examples B and C.

TABLE 4

CHARACTERISTICS OF ABRASIVE COMPOSITE LAYERS

| Abrasive Article | Bottom Layer | Top Layer |
|---|---|---|
| Example 7 | Production Tool II | Production Tool II |
| Example 8 | Production Tool III | Production Tool III |
| Example 9 | Production Tool III | Production Tool III |
| Comparative Example B | Production Tool II | N/A (Not Applicable) |
| Comparative Example C | Production Tool III | N/A |

The durability of Examples 7, 8 and 9 and Comparative Examples B and C were determined as described in the Test Procedure For Measuring The Durability of An Abrasive Article. The results are in Table 5.

TABLE 5

DURABILITY

| Abrasive Article | No. of Contacts Between the Workpiece and Abrasive Article |
|---|---|
| Example 7 | 668 |
| Example 8 | 775 |
| Example 9 | 828 |
| Comp. B | 281 |
| Comp. C | 352 |

The results of the testing illustrated that an abrasive article with a thick abrasive coating having at least two abrasive composite layers (Examples 7, 8 and 9) was more durable than an abrasive article having a thin abrasive coating with a single abrasive composite layer. The abrasive article with a thick abrasive coating was able to contact the workpiece a larger number of times than an abrasive article with a thin abrasive coating, before the coat was essentially eroded.

Example 10 & Comparative Examples D and E

The abrasive articles of Example 10 and Comparative Examples D and E were made by the process described in General Procedure I For Making An Abrasive Article. The components of the abrasive articles of Example 10 and Comparative Example D were: 1000 parts PRO, 750 parts CMSC, 50 parts SCA, 20 parts ASF, and 5 parts KBI and then adding 42 parts AO (having an average particle size of about 45 micrometers) to 58 parts of the mixture. The components of Comparative Example E were: 56.76 parts of a 70/30 blend of TMPTA/TATHEIC, 39.17 parts KBF4, 2 parts SCSA, 2 parts ASF and 0.57 parts pH 2.0 and adding 55 parts AO (having an average particle size of about 45 micrometers) to 45 parts of the mixture.

The abrasive articles of Comparative Examples D and E comprised a thin abrasive coating having only one abrasive composite layer. The abrasive article of Example 10 had a thick abrasive coating containing two abrasive composite layers. The bottom abrasive composite layer is defined as being interposed between the top abrasive composite layer and the backing of the abrasive article. The articles of the Comparative Examples have one abrasive composite layer, that is a bottom abrasive composite layer adjacent to a backing. Table 6 summarizes the resulting abrasive article constructions by listing the production tools used for the first and second composite layers and the depths of the cavities in the production tools for Example 10 and Comparative Examples D and E.

TABLE 6

CHARACTERISTICS OF ABRASIVE COMPOSITE LAYERS

| Abrasive Article | Bottom Layer | Top Layer |
|---|---|---|
| Example 10 | Production Tool II | Production Tool II |
| Comparative Example D | Production Tool II | N/A |
| Comparative Example E | Production Tool II | N/A |

Example 10 and Comparative Examples D and E were tested as described in the Test Procedure For Measuring the Durability of An Abrasive Article and the results are reported in Table 7.

TABLE 7

DURABILITY

| Abrasive Article | No. of Contacts Between the Workpiece and Abrasive Article |
|---|---|
| Example 10 | 574 |
| Comp. D | 130 |
| Comp. E | 192 |

The results illustrate that an abrasive article having a thick abrasive coating containing at least two abrasive composite layers (Example 10) was more durable than an abrasive article having a thin abrasive coating containing a single abrasive composite layer. The abrasive article with a thick abrasive coating was able to contact the workpiece a larger number of times than an abrasive article with a thin abrasive coating, before the coat was essentially eroded by the multiple contacts with the workpiece.

We claim:

1. An abrasive article having a thick abrasive coating, the abrasive article comprising:

(a) a first abrasive composite layer comprising a first polymer and first abrasive articles;

(b) a backing; and (c) a second abrasive composite layer comprising a second polymer and second abrasive particles, the second abrasive composite layer coextensive with and interposed between the first abrasive composite layer and the backing, wherein at least one of the abrasive composite layers form an array of shaped abrasive composite structures.

2. The abrasive article according to claim 1, wherein the shaped abrasive composite structures of at least one of the abrasive composite layers are precisely shaped.

3. The abrasive article according to claim 1, wherein both the first and second abrasive composite layers form an array of shaped abrasive composite structures.

4. The abrasive article according to claim 3, wherein the shaped abrasive composite structures of the first and second abrasive composite layers are precisely shaped.

5. The abrasive article according to claim 1, wherein the backing is selected from the group consisting of paper, film, cloth, nonwoven, vulcanized fiber, combinations thereof and treated versions thereof.

6. The abrasive article according to claim 1, wherein the first polymer is prepared from radiation curable polymer precursors.

7. The abrasive article according to claim 6, wherein the radiation curable polymer precursors are a free radical curable resin.

8. The abrasive article according to claim 7, wherein the free radical curable resin is selected from the group consisting of acrylate monomers, acrylated epoxies, acrylated urethanes, acrylated polyesters, acrylated isocyanates and combinations thereof.

9. The abrasive article according to claim 1, wherein the second polymer is prepared from radiation curable polymer precursors.

10. The abrasive article according to claim 9, wherein the radiation curable polymer precursors are a free radical curable resin.

11. The abrasive article according to claim 10, wherein the free radical curable resin is selected from the group consisting of acrylate monomers, acrylated epoxies, acrylated urethanes, acrylated polyesters, acrylated isocyanates and combinations thereof.

12. The abrasive article according to claim 1, wherein the first abrasive particles and the second abrasive particles have the same composition.

13. The abrasive article according to claim 1, wherein the size of the first abrasive particles and the size of the second abrasive particles are the same.

14. The abrasive article according to claim 1, wherein the size of the first abrasive particles and the size of the second abrasive particles are different.

15. The abrasive article according to claim 4, wherein the precise shape of the first abrasive composite structure of the first abrasive composite layer is the same as the precise shape of the second abrasive composite structure of the second abrasive composite layer.

16. The abrasive article according to claim 4, wherein the precise shape of the abrasive composite structures of the first abrasive composite layer is different from the precise shape of the abrasive composite structures of the second abrasive composite layer.

17. The abrasive article according to claim 1, comprising a third abrasive composite layer generally coextensive with and interposed between the first abrasive composite layer and the second abrasive composite layer, wherein the third abrasive composite layer comprises a third polymer.

18. A method of making an abrasive article with a thick abrasive coating having at least one abrasive composite layer forming an array of precisely shaped abrasive composites, comprising the steps of:

(a) applying a first curable abrasive composite layer including first precursor polymer and first abrasive particles to a backing;

(b) curing the first curable abrasive composite layer to form a first cured abrasive composite layer;

(c) applying a second curable abrasive composite layer including second precursor polymer and second abrasive particles onto the first cured abrasive composite layer; and (d) curing the second curable abrasive composite layer to form a second cured abrasive composite layer so that the first cured abrasive composite layer is coextensive and interposed between the backing and the second cured abrasive composite layer, wherein a production tool comprising a plurality of cavities contacts at least one abrasive composite layer prior to curing.

19. The method of claim 18, comprising the step of contacting the cavities of the production tool with the first abrasive composite layer after step (a).

20. The method of claim 18, comprising the step of contacting the first abrasive composite layer into the cavities of the production tool prior to step (a).

21. The method of claim 18, comprising the step of contacting the cavities of the production tool with the second abrasive composite layer after step (c).

22. The method of claim 18, comprising the step of contacting the second abrasive composite layer into the cavities of the production tool prior to step (c).

23. The method of claim 18, comprising the steps of:

(e) applying a third abrasive composite layer including third precursor polymer and third abrasive particles to the second cured abrasive composite layer; and (f) curing the third abrasive composite layer.

24. The method of claim 23, comprising the step of contacting the cavities of the production tool with the third abrasive composite layer after step (e).

25. The method of claim 23, comprising the step of contacting the third abrasive composite layer into the cavities of the production tool prior to step (e).

* * * * *

UNITED STATES PATENT AND TRADEMARK OFFICE

CERTIFICATE OF CORRECTION

PATENT NO. : 5,928,394
DATED : July 27, 1999
INVENTOR(S) : William L. Stoetzel

It is certified that error appears in the above-identified patent and that said Letters Patent is hereby corrected as shown below:

Column 9,
Line 37, "crosslinking" should read -- crosslinking --.

Column 10,
Line 9, after "thereof" add -- . --.
Line 35, "isobomyl" should read -- isobornyl --.

Column 11,
Line 59, after "thereof" add -- . --.

Column 12,
Lines 4 and 19, after "thereof" add -- . --.
Line 30, "Kiun et al." should read -- Klun et al. --.

Column 13,
Line 39, after "thereof" add -- . --.

Column 15,
Line 28, after "thereof" add -- . --.

Column 16,
Line 18, after "thereof" add -- . --.
Line 35, "5,437,7543" should read -- 5,437,754 --.

Column 17,
Line 10, "milled", should read -- milled --.

Signed and Sealed this

Fifth Day of March, 2002

*Attest:*

*Attesting Officer*

JAMES E. ROGAN
*Director of the United States Patent and Trademark Office*